US007419403B1

(12) United States Patent
Paynter

(10) Patent No.: US 7,419,403 B1
(45) Date of Patent: Sep. 2, 2008

(54) ANGLED COAXIAL CONNECTOR WITH INNER CONDUCTOR TRANSITION AND METHOD OF MANUFACTURE

(75) Inventor: Jeffrey Paynter, Momence, IL (US)

(73) Assignee: Commscope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 11/765,869

(22) Filed: Jun. 20, 2007

(51) Int. Cl.
*H01R 9/05* (2006.01)

(52) U.S. Cl. ..... 439/578

(58) Field of Classification Search ..... 439/578, 439/585, 582
See application file for complete search history.

(56) References Cited

U.S. PATENT DOCUMENTS

| | | | | |
|---|---|---|---|---|
| 2,152,504 | A | 3/1939 | Scott et al. | |
| 2,165,961 | A | 7/1939 | Cork et al. | |
| 2,530,064 | A | 11/1950 | Jones | |
| 2,952,823 | A | 9/1960 | Robinson | |
| 4,900,258 | A | 2/1990 | Hnatuck et al. | |
| 5,037,329 | A | 8/1991 | Wright | |
| 5,322,453 | A | 6/1994 | Resnick et al. | |
| 6,126,482 | A | 10/2000 | Stabile | |
| 6,361,348 | B1 | 3/2002 | Hall et al. | |
| 6,454,601 | B1 * | 9/2002 | Vaitkus et al. | 439/578 |
| 6,471,545 | B1 | 10/2002 | Hosler, Sr. | |
| 6,478,618 | B2 * | 11/2002 | Wong | 439/585 |
| 6,540,558 | B1 | 4/2003 | Paagman | |
| 6,719,586 | B2 | 4/2004 | Weidner | |
| 6,817,899 | B1 | 11/2004 | Zerebilov | |
| 6,821,150 | B2 | 11/2004 | Hall et al. | |
| 7,070,440 | B1 | 7/2006 | Zerebilov et al. | |

* cited by examiner

*Primary Examiner*—Truc T Nguyen
(74) *Attorney, Agent, or Firm*—Babcock IP, PLLC

(57) ABSTRACT

An angled coaxial cable connector, having a unitary generally cylindrical inner conductor coaxial within a bore extending between a primary side and a secondary side of an outer body. The inner conductor provided with a first end on a primary longitudinal axis having a transition to a second end on a secondary axis at an angle to the primary longitudinal axis. An outer side of the transition having a planar back angle surface, the planar back angle surface arranged at generally one half of the angle to the longitudinal axis and to the secondary axis, respectively.

20 Claims, 7 Drawing Sheets

ANGLED COAXIAL CONNECTOR WITH INNER CONDUCTOR TRANSITION AND METHOD OF MANUFACTURE

BACKGROUND OF THE INVENTION

1. Field of the Invention

The invention relates to connectors for coaxial cable. More particularly the invention relates to a right angle coaxial connector with improved electrical performance and a cost effective method of precision manufacture.

2. Description of Related Art

Angled coaxial cable connectors, for example right angle connectors, are useful for connecting to an RF device when a cable to device connection with the cable extending normal to the device is undesirable, such as a cable connection to a rack mounted device and or a device located close to an interfering surface such as a wall.

The right angle transition of the inner conductor necessary to form a right angle coaxial connector introduces several problems. First, the right angle transition makes it difficult to insert the inner conductor within the surrounding body, unless the body is formed in multiple pieces, has access covers and or, for example, a soldered connection is made at the transition point once the inner conductor is inserted from one end, which greatly complicates assembly.

Second, the transition introduces an impedance discontinuity into the coaxial transmission line to which the connector is attached. Both smooth larger radius bends and block type sharp corner bends introduce a measurable impedance discontinuity.

Third, depending upon the diameter of the mating coaxial cable and or specific connection interface the connector is designed for, the inner conductor element may be small in size and relatively fragile, significantly complicating cost effective manufacture with high levels of precision.

Competition within the coaxial cable and connector industry has focused attention upon improving electrical performance as well as reducing manufacturing, materials and installation costs.

Therefore, it is an object of the invention to provide a method and apparatus that overcomes deficiencies in such prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
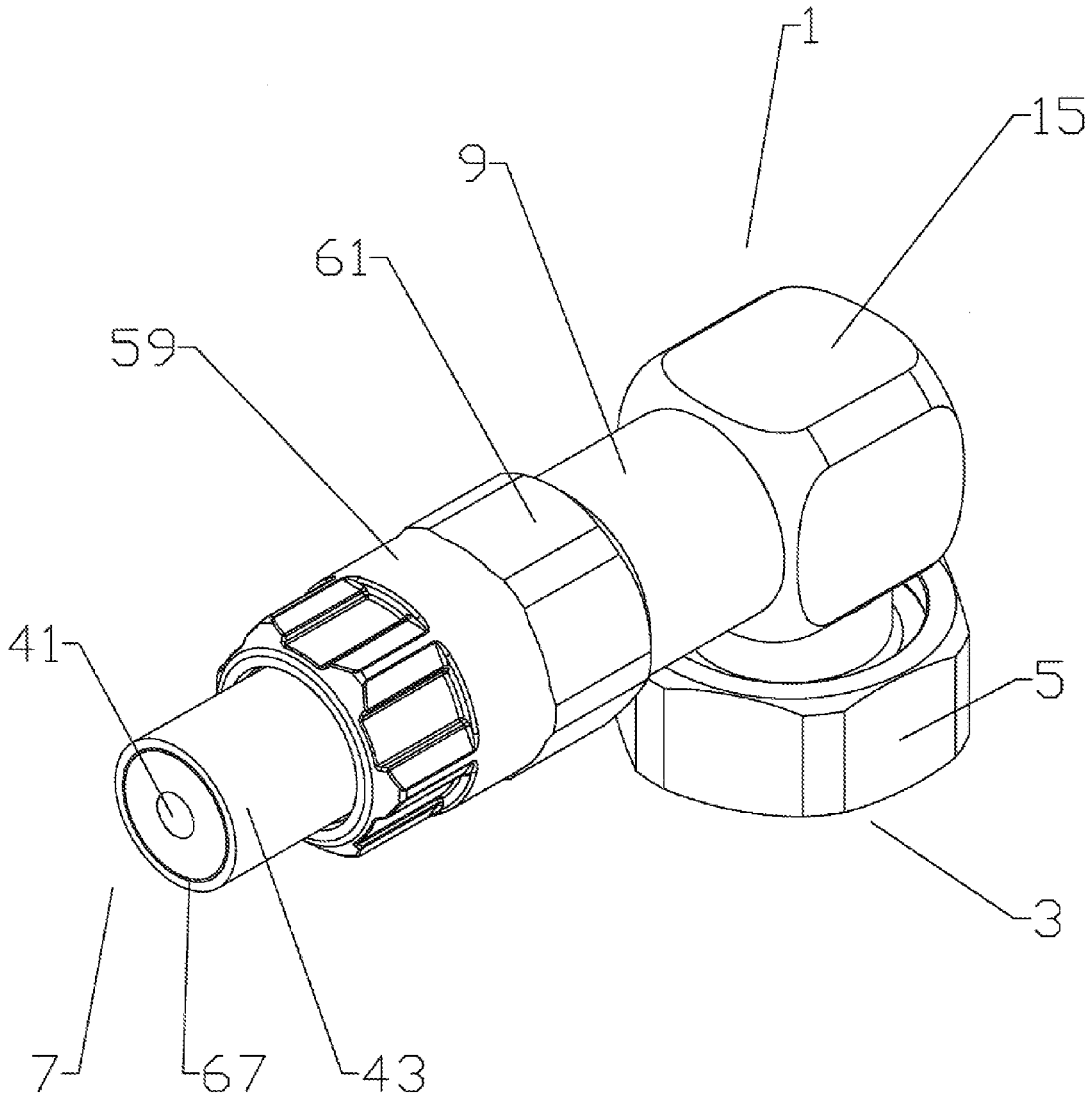
FIG. 1 is an external isometric view of a first exemplary embodiment of an angled connector connected to a coaxial cable demonstrated with a right angle.
Figure 2:
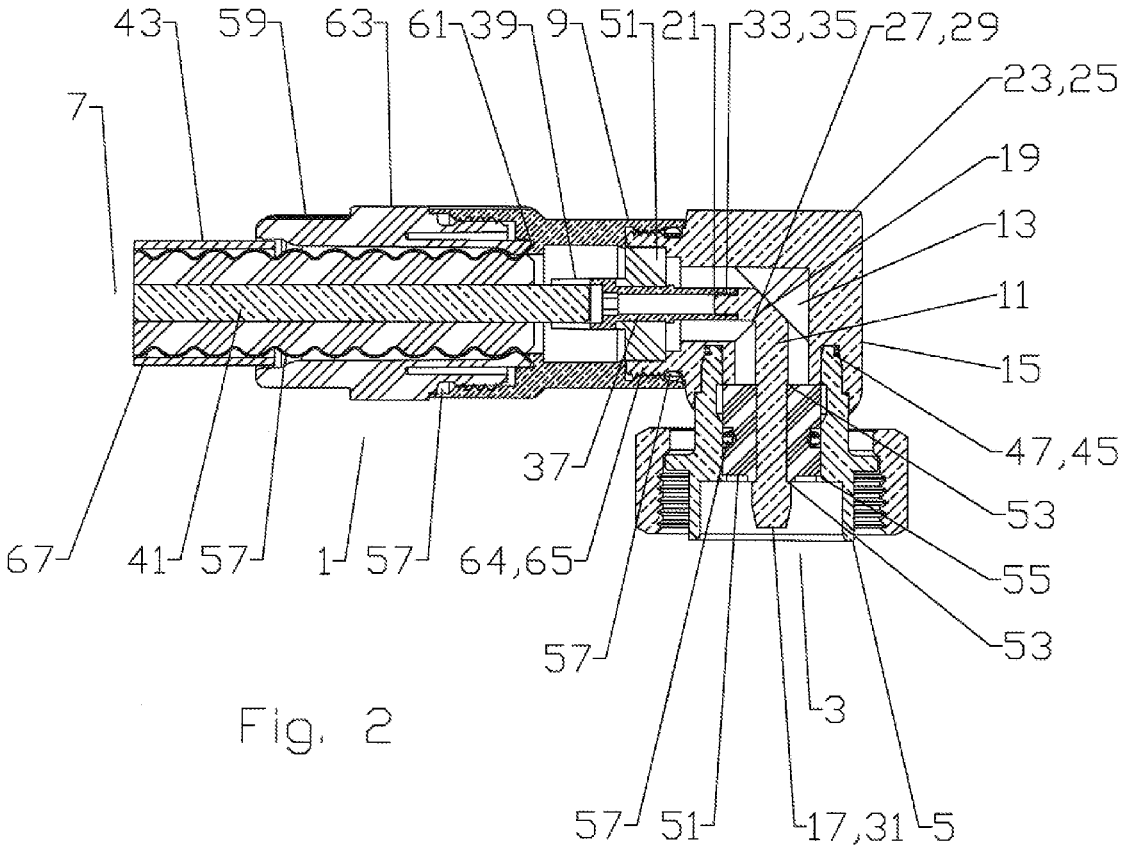
FIG. 2 is a schematic cross section side view of the right angle connector of FIG. 1.

As shown for example in FIGS. 1 and 2 an angled coaxial cable connector 1, according to the invention is demonstrated with a primary side 3 standardized 7-16 DIN connector primary interface 5 and a secondary side 7 with an annular corrugated solid outer conductor coaxial cable 43 secondary interface 9. The connector 1 is demonstrated as a right angle. Alternatively, one skilled in the art will appreciate that any desired angle, connection interface and or coaxial cable interface may be applied to either or both of the primary and secondary sides 3, 7.

The connector 1 has a unitary generally cylindrical inner conductor 11 mounted coaxial within a bore 13 extending between the primary side 3 and the secondary side 7 of an outer body 15. The inner conductor 11 has a first end 17 on a longitudinal axis having a transition 19 to a second end 21 on a secondary axis normal to the primary longitudinal axis. Unitary as used herein defines the inner conductor 11 as formed as a single integral element, not an assembly joined together via mechanical fasteners, soldered or via adhesive from separately fabricated elements. Generally cylindrical as used herein means that, except for the areas of the transition 19, the first end 17 and the second end 21 (depending upon the interfaces selected), the inner conductor 11 has a circular cross section taken along the primary longitudinal axis and the secondary axis, respectively.

Figure 3:
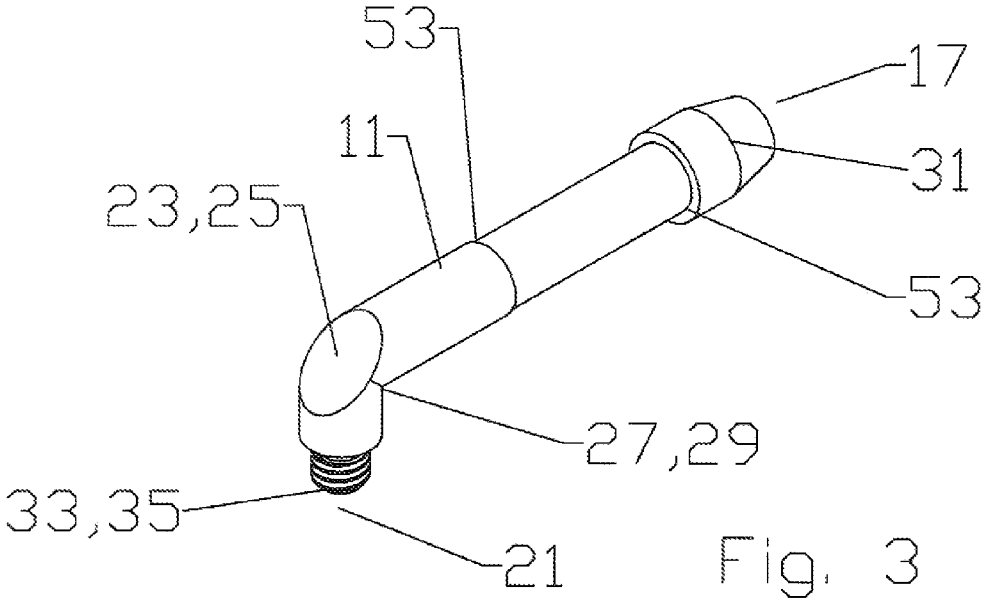
FIG. 3 is an isometric view of an the inner conductor of FIG. 2.
Figure 4:
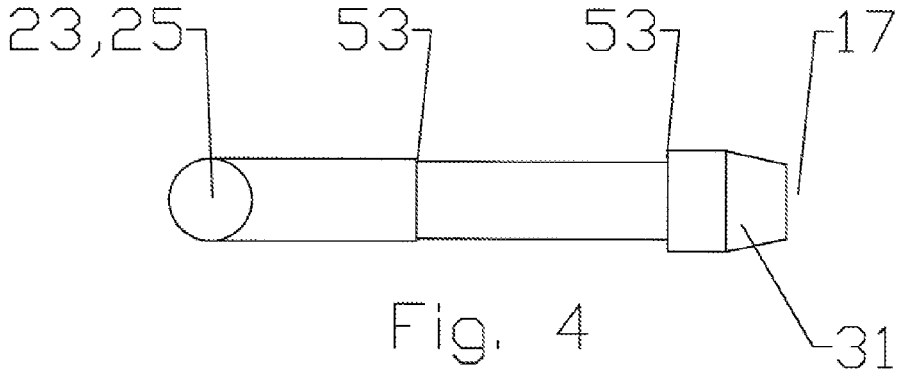
FIG. 4 is a schematic top view of the inner conductor of FIG. 3.
Figure 5:
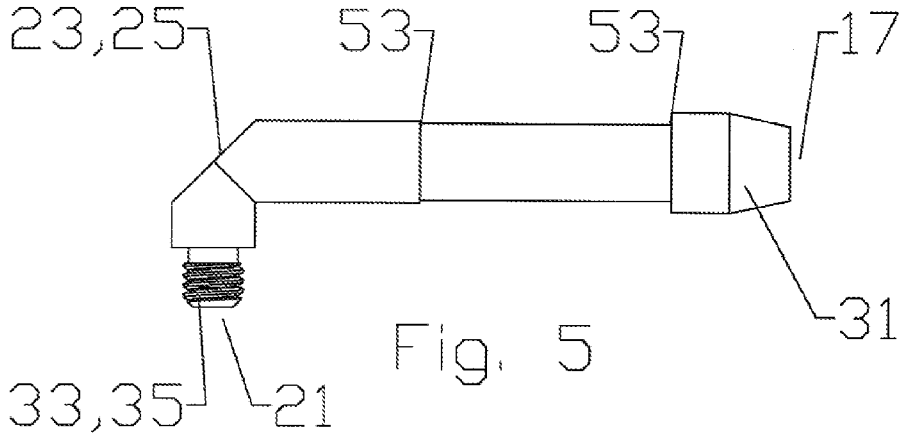
FIG. 5 is a schematic side view of the inner conductor of FIG. 3.

To improve radio frequency electrical performance related to both impedance discontinuity and intermodulation distortion, an outer side 23 of the transition 19 is formed with a planar back angle surface 25, best shown for example in FIGS. 3-5. The planar back angle surface 25 may be arranged symmetrical with both the longitudinal axis and the secondary axis, at one half of the angle between the primary longitudinal axis and the secondary axis, in this case forty-five degrees to both the primary longitudinal axis and to the secondary axis, respectively. An inner side 27 of the transition may be formed with an arc radius or alternatively, a right angle intersection 29.

Viewed from either the first end 17 along the primary longitudinal axis or the second end 21 along the secondary axis, the planar back angle surface 25 extends across the width of the inner conductor 11 presenting an angled "reflective surface" to the direction of signal flow between the longitudinal axis and the secondary axis complementary to the desired angle of the connector, having increasing effects on the inner conductor 11 with respect to reduction of impedance discontinuity and generation of intermodulation distortion as the operating frequency increases.

The first and second ends 17, 21 of the inner conductor 11 are configured for the desired primary and secondary interfaces 5, 9. In the first exemplary embodiment, the first end 17 is demonstrated as a pin 31 for the 7/16 DIN connector interface. The second end 21 has a coupling surface 33 in the form of threads 35. Although shortened to enable easy insertion within the bore 13 of the outer body 15, the portion of the inner conductor 11 extending towards the second end 21 positions the coupling surface 33 spaced away from the transition 19, improving the strength of the inner conductor 11 and compared to locating the coupling surface 33 or other joint at the transition 19, reducing the opportunity for creating additional electrical discontinuity.

The threads 35 of the coupling surface 33 enable easy attachment of a range of different inner conductor interface(s) 37, here demonstrated as a spring basket 39 for securely contacting a solid center conductor 41 of an annular corrugated solid outer conductor coaxial cable 43.

Figure 6:
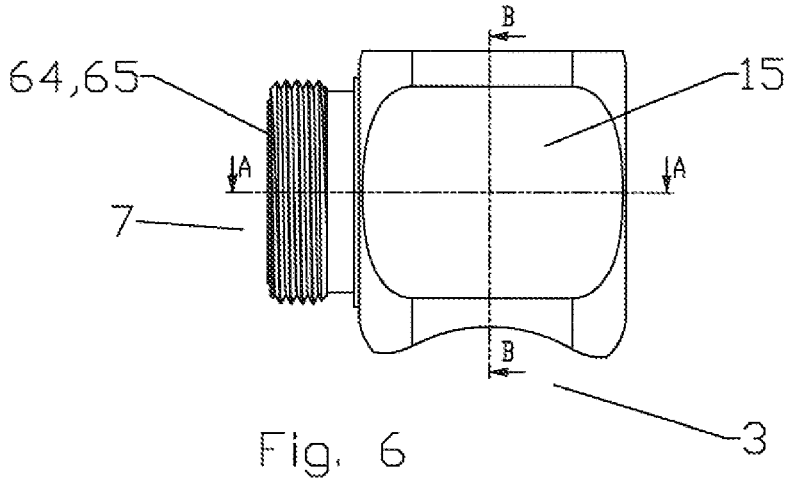
FIG. 6 is a schematic exterior side view of the outer body of FIG. 2.
Figure 7:
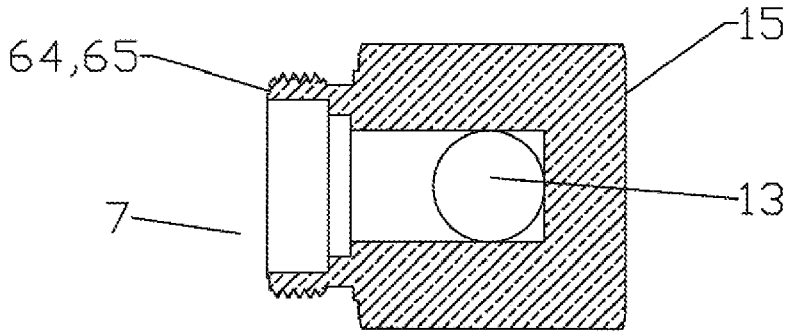
FIG. 7 is a schematic cross section side view of FIG. 6 along line D-D.
Figure 8:
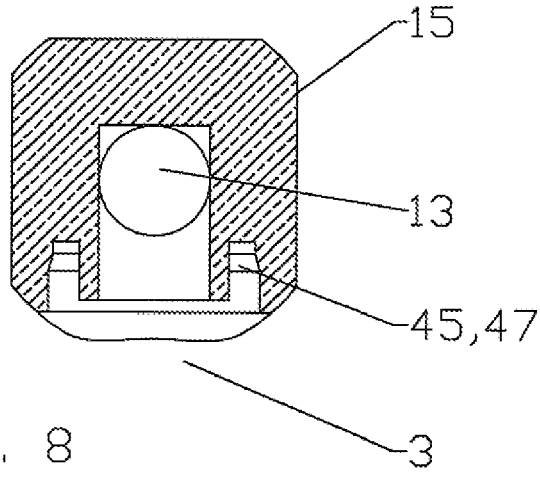
FIG. 8 is a schematic cross section side view of FIG. 6 along line G-G.

As best shown in FIGS. 6-8, the outer body 15 is formed with a bore 13 between primary and secondary sides 3, 7. A primary interface mount 45 is formed in the primary side 3 of the body 15, for example, in the form of an annular groove 47 open the primary side 3, preferably coaxial with the bore 13. A primary interface 5 may be press fit within the annular groove 47, the primary interface 5 carrying an insulator 51 which positions the inner conductor 11 coaxial within the bore 13, retained with respect to the insulator 51 by inner conductor shoulder(s) 53 (see FIG. 2). The insulator 51 may be retained, for example, between the primary side 3 and an interface shoulder 55. A sealing gasket 57, such as an o-ring, may be applied between the insulator 51 and the primary interface 5 to environmentally seal the connector 1, even when unconnected to another connector or device.

At the secondary side 7, the secondary interface 9 is demonstrated as a spring finger nut 59 against outer conductor clamp surface 61 coaxial cable interface 63 attached to the outer body 15 via a secondary interface mount 64 here demonstrated as an integral threaded shoulder 65. An insulator 51 supporting the inner conductor interface 37 seats against a body shoulder 67, retained by an inward projecting lip of the secondary interface 9. Sealing gasket(s) 57 may be applied at the connections between the outer body 15 and the body shoulder 65, between the spring finger nut 59 and the coaxial cable interface 63 and between the outer conductor 67 and the spring finger nut 59 to environmentally seal the connection.

Figure 9:
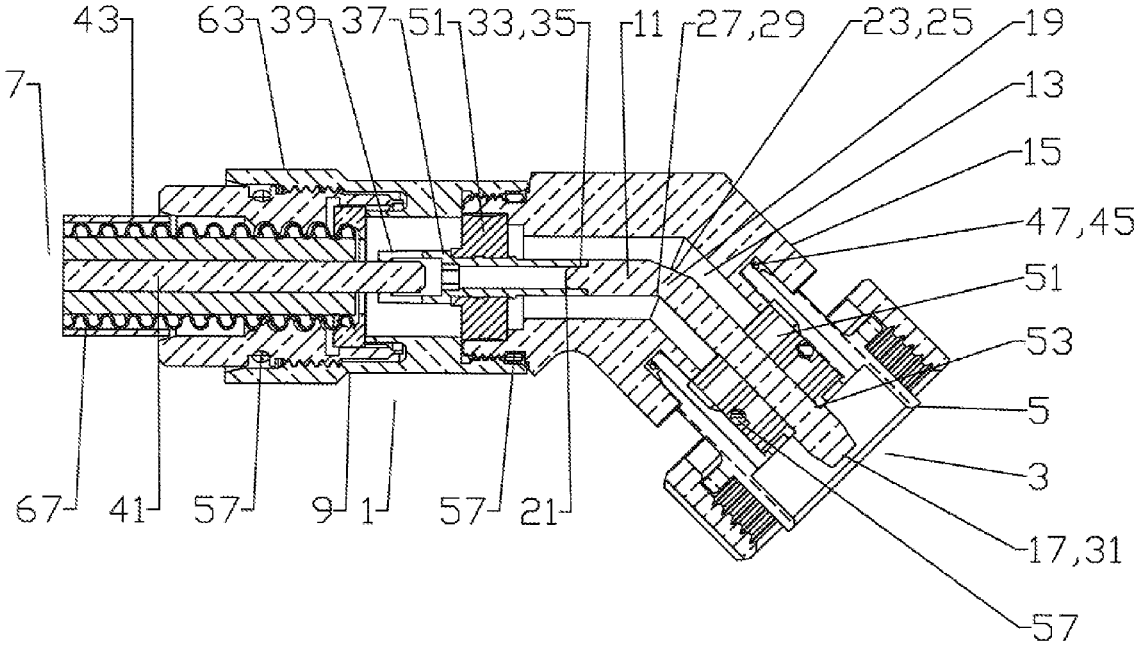
FIG. 9 is a schematic cross section side view of an alternative embodiment with a forty-five degree angle.

FIG. 9, common element notations as described herein above, demonstrates an alternative embodiment, here having an angle of forty five degrees. As the selected angle is reduced, the planar back angle surface 25, is applied symmetrical with both the longitudinal axis and the secondary axis, at one half the angle between the primary longitudinal axis and the secondary axis. Viewed from either the first end 17 along the longitudinal axis or the second end 21 along the secondary axis, the planar back angle surface 25 extends across less than the width of the inner conductor 11 presenting an angled "reflective surface" to the direction of signal flow for only a portion of the conductor cross section. However, because the angle of the connector is reduced, impedance discontinuity effects are reduced even where the reflective surface covers less than the full inner conductor 11 cross section.

Figure 10:
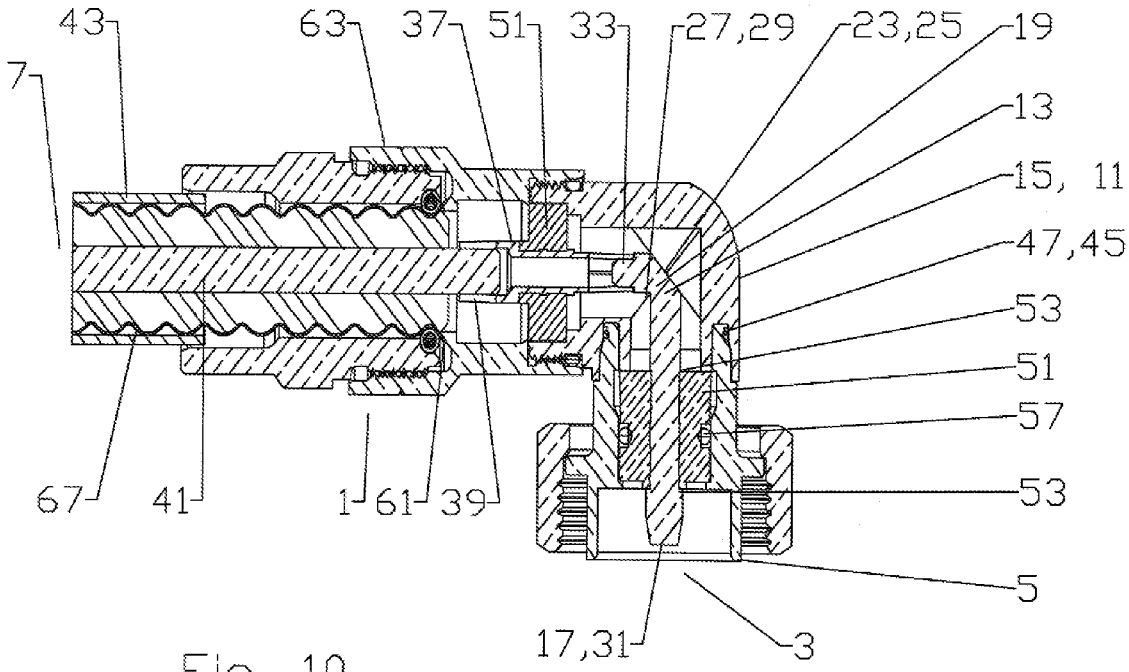
FIG. 10 is a schematic cross section side view of an alternative embodiment with a spring basket inner conductor interface connection to the inner conductor.
Figure 11:
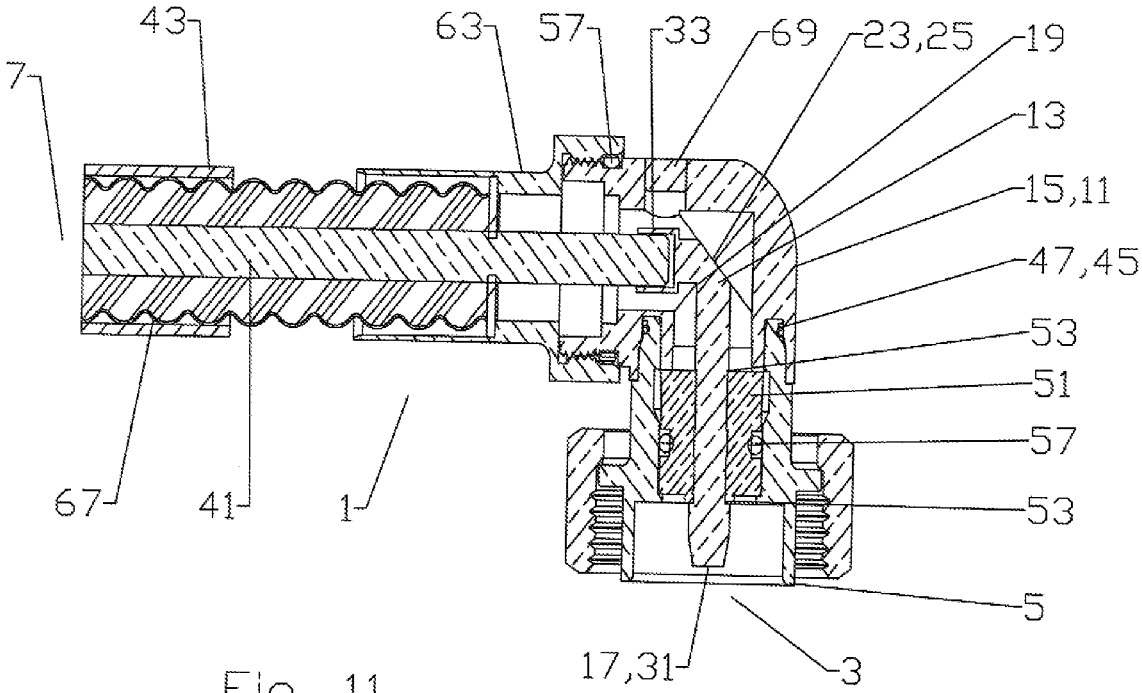
FIG. 11 is a schematic cross section side view of an alternative embodiment with a direct solder connection to the inner conductor.

Alternatives for the coupling surface 33 and further variations of the second interface 9 for specific coaxial cables are demonstrated in FIGS. 10 and 11, common element notations as described herein above. In FIG. 10, the inner conductor interface 37 is coupled to the inner conductor 11 at the coupling surface 33 via a spring basket 39 rather than threads. FIG. 11 demonstrates a direct solder connection of the center conductor 41 to a coupling surface 33 formed as a cavity, eliminating the need for the inner conducor interface 37. Access to the solder area is provided by a solder port 69. Alternatively, the coupling surface 33 can be any connection means, for example, a pin into socket with annular or cantilever snap fit. For maximized electrical performance a conductive adhesive may also be applied to the selected inner conductor interface 37 interconnection with the coupling surface 33.

An angled connector 1 according to the invention may be manufactured using a combination of different techniques each selected to minimize overall costs while generating the different components with a desired level of precision. For example, the elements that are generally concentric, including the relatively small inner conductor interface spring basket 37, may be manufactured via machining or molding depending upon the materials desired. The outer body 15 is relatively simple to mold or machine, having minimal features.

The specific geometry of the inner conductor 11 may be cost effectively formed with high precision via Metal Injection Molding (MIM) or Thixoforming, to reduce the quality control, cost and time requirements associated with high tolerance mechanical machining of a small non-concentric electrical component.

MIM, also known as powder injection molding, is a net-shape process for producing solid metal parts that combines the design freedom of plastic injection molding with material properties near that of wrought metals. With its inherent design flexibility, MIM is capable of producing an almost limitless array of highly complex geometries in many different metals and metal alloys. Design and economic limitations of traditional metalworking technologies, such as machining and casting, can be overcome by MIM.

In a typical MIM process, finely granulated metal material is uniformly mixed with a wax or polymer binder and injection molded. A "green" molded part is then extracted from the mold. A de-binding step extracts the majority of binder from the green part via application of low temperature and or a solvent. The de-bound green part is then sintered at high temperature wherein the de-bound part is proportionally shrunk to the final target size, concentrating the metal density and strength characteristics to close to that of a casting made from the same material by conventional means.

The inventor has recognized that MIM manufacturing technologies may be applied to form the precision shapes of inner conductors described herein using a range of metals and or metal alloys. Because of the minimal waste inherent in the MIM manufacturing process, although the superior electromechanical properties of a metal is realized, the material cost is minimized because extremely low waste occurs relative to metal machining.

Thixoforming is another highly advantageous method of forming the inner conductor via thixotropic magnesium alloy metal injection molding technology. By this method, a magnesium alloy is heated until it reaches a thixotropic state and is then injection molded, similar to plastic injection molding techniques. Thereby, an inner conductor according to the invention may be cost effectively fabricated to high levels of manufacturing tolerance and in high volumes. The, for example, magnesium alloys used in thixotropic metal molding have suitable rigidity characteristics and also have the benefit of being light in weight.

The invention provides a cost effective right angle coaxial connector 1 with improved electrical performance despite having a minimum number of separate components. Also, materials cost and the complexity of required assembly operations are reduced. Installation of the connector onto the cable may be reliably achieved with time requirements and assembly operations similar those of a conventional straight body coaxial connector.

| Table of Parts | |
|---|---|
| 1 | connector |
| 3 | primary side |
| 5 | primary interface |
| 7 | secondary side |
| 9 | secondary interface |
| 11 | inner conductor |
| 13 | bore |
| 15 | outer body |
| 17 | first end |
| 19 | transition |
| 21 | second end |
| 23 | outer side |
| 25 | planar back angle surface |
| 27 | inner side |
| 29 | right angle intersection |
| 31 | pin |
| 33 | coupling surface |
| 35 | threads |
| 37 | inner conductor interface |
| 39 | spring basket |
| 41 | center conductor |
| 43 | cable |
| 45 | primary interface mount |
| 47 | annular groove |
| 51 | insulator |
| 53 | inner conductor shoulder |
| 55 | interface shoulder |
| 57 | sealing gasket |
| 59 | spring finger nut |
| 61 | outer conductor clamp surface |
| 63 | coaxial cable interface |
| 64 | secondary interface mount |
| 65 | body shoulder |
| 67 | outer conductor |
| 69 | solder port |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. An angled coaxial cable connector, comprising:

a unitary generally cylindrical inner conductor coaxial within a bore extending between a primary side and a secondary side of an outer body;

the inner conductor provided with a first end on a primary longitudinal axis having a transition to a second end on a secondary axis arranged at an angle with respect to the primary longitudinal axis;

an outer side of the transition having a planar back angle surface, the planar back angle surface disposed at generally one half of the angle between the longitudinal axis and the secondary axis.

2. The connector of claim 1, wherein the planar back angle surface extends across a width of the inner conductor.

3. The connector of claim 1, wherein the primary longitudinal axis and the secondary axis are angled at ninety degrees.

4. The connector of claim 1, wherein the inner conductor has a coupling surface on the second end.

5. The connector of claim 4, wherein the coupling surface is threaded.

6. The connector of claim 1, wherein the coupling surface is spaced away from the transition.

7. The connector of claim 1, further including an inner conductor interface coupled to the coupling surface.

8. The connector of claim 1, further including a primary interface mount formed in the primary side of the outer body.

9. The connector of claim 1, further including a secondary interface mount formed in the secondary side of the outer body.

10. The connector of claim 1, wherein the inner conductor is retained coaxial within the bore by an insulator mounted within an interface coupled to the primary side.

11. The connector of claim 1, wherein an inner side of the transition surface is a right angle intersection.

12. The connector of claim 1, wherein the primary interface mount is an annular groove in the primary side of the outer body, the annular groove open to the primary side and concentric with the bore at the primary side.

13. The connector of claim 12, further including a primary interface press fit into the annular groove, an interface shoulder of the primary interface projecting inward to retain an insulator against the primary side of the outer body.

14. A method for manufacturing a right angle coaxial connector, comprising the steps of:

forming a unitary generally cylindrical inner conductor with a first end on a primary longitudinal axis having a transition to a second end on a secondary axis at an angle to the longitudinal axis; an outer side of the transition having a planar back angle surface, the planar back angle surface arranged at generally one half of the angle to the longitudinal axis and to the secondary axis, respectively; and inserting the inner conductor coaxial within a bore extending between a primary side and a secondary side of an outer body.

15. The method of claim 14, further including the step of coupling a spring basket to a coupling surface on the second end of the inner conductor.

16. The method of claim 14, wherein the inner conductor is retained coaxial within the bore by an insulator mounted in an interface, the interface coupled to a primary side of the body.

17. The method of claim 14, wherein the forming step is via metal injection molding.

18. The method of claim 14, wherein the forming step is via thixoforming.

19. The method of claim 14, further including the step of attaching a coaxial cable interface to the second side of the outer body.

20. A right angle coaxial cable connector, comprising:

a unitary generally cylindrical inner conductor coaxial within a bore extending between a primary side and a secondary side of an outer body;

the inner conductor provided with a first end on a longitudinal axis having a transition to a second end on a secondary axis normal to the primary longitudinal axis;

the second end having a coupling surface to which a spring basket is coupled;

an outer side of the transition having a planar back angle surface, the planar back angle surface arranged at forty five degrees to the longitudinal axis and to the secondary axis, respectively;

an inner side of the transition is a right angle interconnection;

the inner conductor is retained coaxial within the bore by an insulator mounted within an interface coupled to the primary side; and a coaxial cable interface coupled to the secondary side of the outer body.

* * * * *